US007563166B2

(12) United States Patent
Nguyen et al.

(10) Patent No.: US 7,563,166 B2
(45) **Date of Patent: *Jul. 21, 2009**

(54) METHOD AND APPARATUS FOR VERIFYING GAME OUTCOME

(75) Inventors: Binh T. Nguyen, Reno, NV (US); Craig A. Paulsen, Reno, NV (US)

(73) Assignee: IGT, Reno, NV (US)

( * ) Notice: Subject to any disclaimer, the term of this patent is extended or adjusted under 35 U.S.C. 154(b) by 590 days.

This patent is subject to a terminal disclaimer.

(21) Appl. No.: 11/181,093

(22) Filed: Jul. 13, 2005

(65) Prior Publication Data

US 2006/0035703 A1 Feb. 16, 2006

Related U.S. Application Data

(63) Continuation of application No. 10/243,353, filed on Sep. 13, 2002, now Pat. No. 6,926,605.

(51) Int. Cl.
*A63F 9/24* (2006.01)

(52) U.S. Cl. ..... 463/22

(58) Field of Classification Search ..... None
See application file for complete search history.

(56) References Cited

U.S. PATENT DOCUMENTS 4,283,709 A 8/1981 Lucero et al.
4,710,873 A 12/1987 Breslow et al.
5,278,643 A * 1/1994 Takemoto et al. ..... 348/150
5,397,133 A 3/1995 Penzias
5,797,795 A 8/1998 Takemoto et al.
5,917,725 A 6/1999 Thacher et al.
5,947,821 A * 9/1999 Stone ..... 463/13

(Continued)

FOREIGN PATENT DOCUMENTS

DE 19756693 6/1999

(Continued)

OTHER PUBLICATIONS

Search Report for Application No. GB 0321515.9 dated Jan. 12, 2004.

(Continued)

*Primary Examiner*—Ronald Laneau
*Assistant Examiner*—Tramar Harper
(74) *Attorney, Agent, or Firm*—Weaver Austin Villeneuve & Sampson LLP

(57) ABSTRACT

A method and apparatus is disclosed for verifying the outcome of a game played on a gaming machine having at least one rotatable reel, the position of the at least one reel associated with the outcome of the game. The apparatus includes at least one image collection device arranged to collect one or more images of the reel(s) for use in verifying the position of the reel(s) at one or more times. Session data may also be collected and stored. In one embodiment, the image collection device comprises a camera, and the apparatus includes a controller and a memory for storing image information. In accordance with a method, image information regarding the position of the one or more reels of the gaming machine is collected. In one embodiment, the image and session information is stored locally and/or transmitted to a remote location via a communication link.

40 Claims, 3 Drawing Sheets

U.S. PATENT DOCUMENTS

| | | | | |
|---|---|---|---|---|
| 5,966,715 | A | 10/1999 | Sweeney et al. | |
| 5,970,143 | A * | 10/1999 | Schneier et al. | 713/181 |
| 6,018,720 | A | 1/2000 | Fujimoto | |
| 6,068,552 | A * | 5/2000 | Walker et al. | 463/21 |
| 6,071,190 | A | 6/2000 | Weiss et al. | |
| 6,120,379 | A | 9/2000 | Tanaka et al. | |
| 6,131,192 | A | 10/2000 | Henry | |
| 6,142,876 | A | 11/2000 | Cumbers | |
| 6,167,562 | A | 12/2000 | Kaneko | |
| 6,219,836 | B1 | 4/2001 | Wells et al. | |
| 6,379,245 | B2 * | 4/2002 | De Keller | 463/13 |
| 6,477,251 | B1 | 11/2002 | Szrek et al. | |
| 6,554,704 | B2 * | 4/2003 | Nicastro et al. | 463/20 |
| 6,577,733 | B1 * | 6/2003 | Charrin | 380/251 |
| 6,595,856 | B1 | 7/2003 | Ginsburg et al. | |
| 6,641,484 | B2 | 11/2003 | Oles et al. | |
| 6,675,382 | B1 | 1/2004 | Foster | |
| 6,692,361 | B1 | 2/2004 | Itskov | |
| 6,780,106 | B2 | 8/2004 | DeMar et al. | |
| 2002/0147047 | A1 | 10/2002 | Letovsky et al. | |
| 2002/0196342 | A1 * | 12/2002 | Walker et al. | 348/157 |
| 2003/0195037 | A1 | 10/2003 | Vuong et al. | |
| 2003/0195043 | A1 * | 10/2003 | Shinners et al. | 463/42 |
| 2003/0228906 | A1 * | 12/2003 | Walker et al. | 463/40 |

FOREIGN PATENT DOCUMENTS

| | | |
|---|---|---|
| GB | 2345862 | 7/2000 |
| GB | 2356483 | 5/2001 |
| WO | WO 01/41892 | 6/2001 |

OTHER PUBLICATIONS

International Search Report for Application No. PCT/US03/27130 dated Jan. 14, 2004.

Australian Office Action, dated Jan. 19, 2009, from related Australian Application No. 2003246322.

* cited by examiner

METHOD AND APPARATUS FOR VERIFYING GAME OUTCOME

FIELD OF THE INVENTION

The present invention relates to gaming machines, and more particularly, to methods and apparatus for determining the outcome of a game played on a gaming machine.

BACKGROUND OF THE INVENTION

A variety of gaming devices currently exist for presenting games of skill and/or chance to a player. These games are presented based upon a wager placed by the player and provide the opportunity for the player to be paid winnings if the outcome of the game is a particular outcome.

One particular type of gaming machine is known as a "reel" machine, as the machine includes a plurality of reels carrying a variety of indicia or symbols. Play of the game involves rotation of the reels and, if the indicia displayed by the reels at a stopped position are a winning combination of indicia, awarding the player a winning.

These reel type gaming machines used to be mechanically operated, but are now generally electronically controlled. The gaming device includes a processing device including a random number generator. Randomly generated numbers are correlated to stopping positions for the reels. The position of each reels is controlled by a stepper motor or the like. Such an arrangement is described in U.S. Pat. No. 4,448,419 to Telneas. If the generated random numbers corresponding to stopping positions of the reels are detected to comprise stopping positions which result in the display of a winning set of indicia, then the gaming machine is arranged to pay the player a winning.

Unfortunately, circumstances arise when a player may believe that the outcome of the game is a winning outcome, while the gaming device indicates the contrary. This may give rise to a dispute between the player and the game operator, such as a casino or gaming company.

Circumstances may arise in which there is a dispute regarding the outcome of the game. In general, these disputes are undesirable, since negative publicity may be generated regarding the game operator's alleged non-payment to the player. On the other hand, the game operator is only obligated to pay winnings when the outcome of the game is truly a winning outcome. In some circumstances, unscrupulous players may actually allege that the outcome of the game was a winning outcome when it was not at any time, in an attempt to extort monies from the game operator.

Unfortunately, no means currently exists for accurately monitoring or verifying the operation of the gaming machine. For example, the game operator may obtain data regarding the play of the game from the gaming controller. However, if a malfunction occurred, the data itself might be corrupt and only indicate the malfunction. Other security measures are sometimes thwarted by unscrupulous players. For example, gaming personnel may attempt to watch various gaming machines, but they can not watch all of the machines' all of the time, and players may attempt to block the view of the machine if they attempt to tamper with it.

A means for verifying the outcome or condition of a gaming machine is desired.

SUMMARY OF THE INVENTION

The present invention comprises methods and apparatus for verifying the outcome of a game presented by a gaming machine. The method and apparatus is applicable to gaming machines of a variety of types, but is particularly applicable to the well-known reel-type slot machine.

The slot machine may have a number of configurations. In one embodiment, the slot machine includes a housing. Inside the housing are located one or more reels arranged to display indicia to a player. As is known, a combination of indicia displayed by the reels is indicative of an outcome of a game played on the machines.

In one arrangement, the reels include a rotating reel strip on which indicia are displayed, such as by printing. The reel strip is mounted for rotation on a reel support. The reel support is supported by a mount connected to the housing or other portion of the gaming machine. The housing of the gaming machine includes one or more windows through which the reel strips of the reels are visible by a player.

The gaming machine may be operated in a variety of manners. In general, however, the reels are rotated, and their stopping position determines or is indicative of the outcome of the game played on the machine. In one embodiment, the stopping position of each reel is controlled by a stepper motor, the stopping position determined randomly. A gaming machine controller calculates the stopping positions of the reels and determines if the stopping positions correspond to a winning outcome of the game. Generally, the indicia displayed by the reels and viewable through the window or windows, such as those indicia specifically aligned with a payline, comprise or define the result of the game.

In accordance with an embodiment of an apparatus of the invention, the outcome of a game played on the machine is verified by at least one image collection device. In one embodiment, the image collection device comprises a camera. The camera is configured to collect image information regarding one or more of the reels, which image information may be used to verify whether the stopping position of the reels corresponded to or defined a winning result of the game.

In one embodiment, at least one camera is arranged to collect image information regarding each of the reels. In one embodiment, the camera is directed to collect the image of the reel strip in the area of the window through which the player views the indicia comprising the outcome of the game. In another embodiment, the camera is directed to collect the image of the reel strip in another location, and the indicia which are displayed to the player and which comprise or define the result of the game are determined by knowing the relative locations of the indicia on the reel strips.

The camera may be used to directly or indirectly collect the image information. For example, the image information may be reflected off of a mirror or transmitted through an optical fiber, lens or the like to the camera.

In one embodiment, the camera or other image collection device is mounted to the reel, such as the reel mount. In another embodiment, the camera is located within a periphery defined by the reel support about which the reel strip rotates.

In one embodiment, other non-image information may be collected at one or more times, such as simultaneously with the image information. In one embodiment, information regarding a player's inputs, such as depression of one or more buttons or inputting coins or cash, is collected and stored. Other information, such as game control and outcome information may also be collected and stored. In one embodiment, the information or data is stored in one or more session files.

The session information and the image information may be synchronized using time of occurrence information, such as time stamp information. In this manner, the information may be presented simultaneously.

The apparatus may include a memory and/or other devices or elements. The memory may comprise a re-writeable memory of fixed capacity, with older image information overwritten by newly collected information in loop fashion. In one or more embodiments, the image information may be transmitted to a remote location, such as a remotely located security station. In this embodiment, the camera(s) may be connected to one or more controllers, the controllers connected to or including a communication interface. The communication interface may be used to establish a link with a network or other communication path to the remote security station.

In one embodiment, the method of the invention comprises collecting reel image and/or session information for verification of game outcomes and to capture malfunctions. The method may include the storage of the image and/or session information and/or the transmission of the image and/or session information to the remote security station or other location.

In one embodiment of the invention, the reel image and/or session information may be used or replayed for various purposes, including to verify the outcome of a game. In one embodiment, the image information may be replayed at a video display at the gamine device, such as at an LCD screen of a player tracking device associated with the gaming machine. The replay may also be effected at a remote location, such as a remote computer. In one embodiment, the session information, such as information regarding a player input, is displayed simultaneously with the image information.

Further features and advantages of the present invention over the prior art will become apparent from the detailed description of the drawings which follows, when considered with the attached figures.

DETAILED DESCRIPTION OF THE INVENTION

In one or more embodiments, the invention comprises a gaming machine which includes at least one gaming machine condition data collection device. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises a gaming machine including at least one data collection device configured to collecting data regarding at least one condition of the gaming machine. In one embodiment, the data collected regards the position of reels as a function of time of the gaming machine, and more specifically, the indicia which are displayed by those reels to the player as the result of the outcome of a game played on the gaming machine.

Besides the image information, player input or other gaming machine event information may be collected and stored, such as in a session file. The session information or data may also be used to recreate the play of the game. The session data may be displayed simultaneously with the image information. In one embodiment, the session data is synchronized with the image information, such as by use of time stamp data. In one embodiment, the controller of an image collection device obtains information from a gaming machine controller, allowing the collected image information to be synchronized in time with other collected information.

Figure 1:
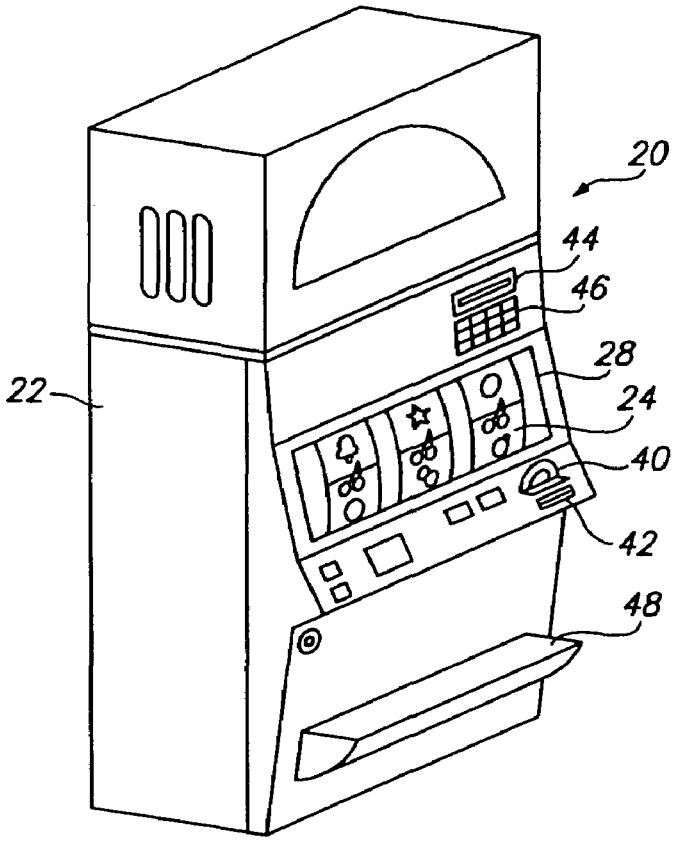
FIG. 1 is a perspective view of a gaming machine comprising one environment for an apparatus and method of the present invention, the gaming machine including a plurality of reels.

Referring to FIG. 1, there is illustrated one embodiment of a gaming machine 20 in accordance with the present invention. In general, the gaming machine 20 is adapted to present at least one game for play to a player. As illustrated, the gaming machine 20 includes a housing 22 which supports and/or houses the various components of the gaming machine 20.

Figure 2A:
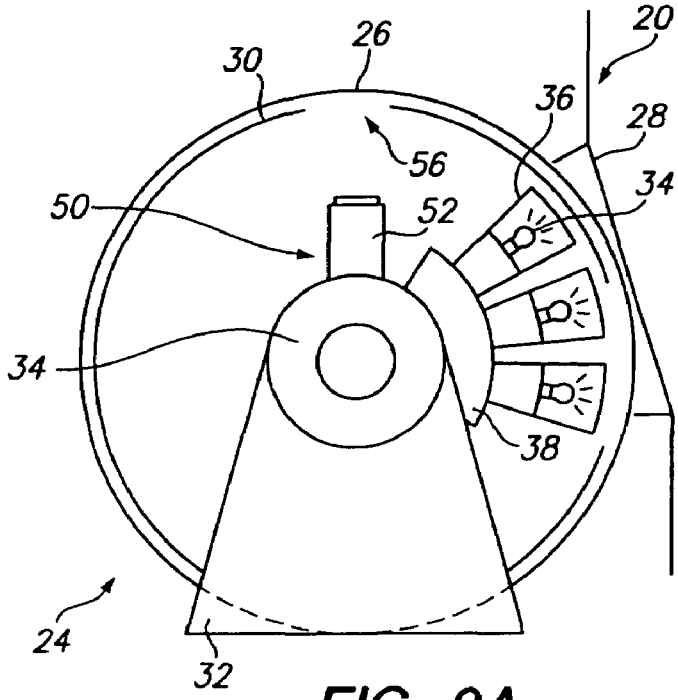
FIG. 2A is a side view of a reel of the gaming machine illustrated in FIG. 1 including an image collection device in accordance with an embodiment of the invention.

In one embodiment, the gaming machine 20 is a "reel" type machine in which indicia are randomly displayed to a player, and the outcome of the game depends upon the combination of indicia which are displayed by the reels of the machine 20. FIG. 2A illustrates generally one embodiment of a reel 24 of the gaming machine 20. In the embodiment illustrated in FIG. 1, it will be seen that the machine 20 is illustrated as including three reels 24. The gaming machine 20 may include a greater or lesser number of reels.

In the embodiment illustrated in FIG. 2A, the reel 20 includes a reel strip 26 which carries a plurality of indicia or symbols for display to the player. The reel strip 26 comprises a loop of material having an inner surface and a outer surface. The reel strip 26 carries the indicia for viewing from the outer surface thereof. In one or more embodiments, the reel strip 26 is generally clear and the indicia are printed on the outer surface or exterior of the strip 26. Those of skill in the art will appreciate that the reel strip 26 may be constructed in a variety of manners and that the indicia may vary in type and number.

The reel strip 26 is mounted for rotation in a manner permitting the display of the various indicia through a window 28. Referring to FIG. 1, when the gaming machine 20 includes three reels 24, a single elongate window 28 may be positioned in a front panel of the machine 20 for viewing all three reel strips 26. In general, the window 28 comprises a transparent element, such as glass, which protects the reel strip 26 but permits viewing there through. The window 28 may comprise an opening, multiple openings or transparent areas or have other configurations.

In one embodiment, the reel strip 26 is mounted on a reel support 30. The reel support 30 is generally cylindrical in shape, thus having an outer surface supporting the reel strip 26 in a circular pathway. The reel support 30 defines an inner area within which other components may be located.

The reel support 30 is, in turn, connected to a mount 32. The mount 32 is connected to a portion of the gaming machine 20 for support. For example, the mount 32 may be connected to an internal shelf, support bars or the like. In general, the mount 32 affixes the reel 24 in a particular position. The form and structure of the mount 32 may vary.

A means is provided for rotating the reel strip 26 to align the indicia thereon with the window 28. In one embodiment, this means comprises at least one motor 34. The motor 34 is preferably electrically operated and may be of the "stepper" type, so that individual stopping positions of the motor 34, and thus the reel strip 26, may be selected.

In one embodiment, means are provided for illuminating the indicia on the reel strip 26 for better viewing. In one embodiment, the means comprises a light 34. The light 34 may be of a variety of types, such as electrically powered incandescent.

As illustrated, the light 34 is positioned so that it illuminates the reel strip 26 from its inside or interior. In one embodiment, the light 34 is connected to a base 38 which is supported by the mount 32.

Referring to FIG. 1, in one embodiment, the window 28 and reel strip 26 of each reel 24 are configured so that three indicia are displayed to a player when the reel 24 is in it stopped state or position. As such, three lights 34 are preferably provided for illuminating each of the three indicia, as best illustrated in FIG. 2A.

In order to concentrate the generated light, a shield or shade 36 is preferably positioned around each light 34. In one embodiment, the shield or shade extends to a position very close to the interior or inside of the reel strip 26, so as to prevent the light 34 from illuminating areas other than the indicia located directly in front of it.

As indicated, the configuration of the reels 24 may vary, and such variations in configuration are well known to those of ordinary skill in the art. The methods and apparatus of the invention are not limited to use with a reel 24 configured as illustrated, but may be used with other configurations of reels now known or later developed.

The gaming machine 20 includes a variety of controls and other features for presenting a game utilizing the reels 24. In one or more embodiments of the invention, the gaming machine 20 is adapted to present a wager-type game. In this arrangement, a player is required to place a bet or wager in order to participate in the game. In the event the outcome of the game is a winning outcome, then the player may be provided with an award. In one arrangement, the award may be winnings based upon the amount wagered or bet by the player.

In order to accept a wager, the gaming machine 20 may include a coin acceptor 40 for accepting coins. The gaming machine 20 may also include a bill acceptor or validator 42 for accepting paper currency. The gaming machine 20 may be provided with other means for accepting or verifying value, such as a credit card reader.

In one embodiment, the gaming machine 20 may include a card reader 44 for reading credit cards and/or player tracking cards. A keypad 46 or other input device may also be provided which permits a player to enter information, such as player identification information such as a password or PIN. Such player tracking devices, including various input devices which may be employed, are well known.

The gaming machine 20 may include a variety of player input devices. For example, push-type buttons or other input accepting elements may be provided. A player may utilize these buttons to place bets, initiate games and the like. Such input devices and their operation are well known.

In one embodiment of the game, a player may be awarded a prize or payout if the outcome of the game comprises a predetermined combination of indicia displayed by the reels 24. In one embodiment, the award may be paid in coins, such as to a coin tray 48. In other embodiments, the award may be paid as a ticket, electronically indicated credit or the like.

It should be understood that the gaming machine 20 may be adapted to present one or more of a wide variety of games. Depending upon the game presented, the configuration of the machine may vary.

In one embodiment, a controller (not shown) may be used to control the position of the reels 24. For example, upon initiating a game, a random number generator may be used to randomly determine the stopping position of each of the reel strips 26.

In one embodiment, a payline is displayed on the window 28. The center of the three indicia displayed by each reel 24 is aligned with the payline when the reel 24 stops. The indicia of the reels 24 aligned with the payline define or comprise the outcome of the game. The other indicia which are visible to the player in positions above and below the indicia aligned with the payline are displayed to indicate to a player how "close" the player was to achieving other combinations of indicia.

As detailed above, the indicia which align with the payline when the reels 24 are stopped are determined by the randomly selected stopping position generated by the gaming controller or by a remote game server. The gaming controller thus determines if the outcome of the game is a winning outcome by using the generated stopping position data of the reels 24, and not upon the actual indicia aligned with the paylines.

As indicated, in accordance with the invention, the gaming machine 20 includes at least one data collection device. In one embodiment, the data collection device comprises a means for verifying the outcome of a game played on the gaming machine 20. In a preferred embodiment of the invention, this means is independent of the gaming controller. Preferably, the means comprise at least one image collection device associated with the gaming machine 20 for obtaining image information regarding a condition of the gaming machine. Most preferably, this condition comprises a position of the one or more reel strips 26.

The image collection device may comprise a variety of types of devices. In one embodiment, the image collection device comprises a camera 50. The camera 50 or other image collection device may comprise a CCD, CMOS type image collection device, a CIS type device, infrared optical scanner, an LED optical sensor (reflective or transmissive), a magnetic Hall-effect sensor, or other devices as are now known or later developed. As one example of an alternate arrangement, the inside surface of the reel strip may be printed or encoded, such as with barcodes or the like, the barcodes providing location information. In the case of bar-code printing, an optical scanner or the like may be utilized to read the barcodes.

Preferably, the camera 50 provides an output signal representative of image information collected through a lens or other collection source or input thereof. This output signal may comprise an analog or digital signal. For example, CIS devices may be configured to output either binary (digital) or analog signals. Such devices are available from the Peripheral Imaging Corporation of San Jose, Calif.

The image collection device may be arranged to generate single frame or multi-frame (moving image) data or video, may include optical and/or digital zoom, light compensation and other features, and generate black and white or color image information. Other features of the camera may include auto focus, macro focus, use of differing types of lenses (such as wide angle or telephoto), interchangeability of lenses, and use of filters such as polarizing filters and color filters, among others.

The camera 50 or other image collection device, as the case may be, is preferably mounted to or supported by the gaming machine 20. As illustrated, in one embodiment, the camera 50 has a body 52. The body 52 is mounted to a portion of the gaming machine 20. In the embodiment illustrated, the body 52 of the camera 50 is mounted to the reel mount 32. The camera 50 may be connected to the gaming machine 20 in a variety of ways, including by straps, fasteners, brackets or the like.

The camera 50 may be positioned in a number of locations. As indicated, the camera 50 is preferably positioned to obtain image information regarding the outcome of a game played on the gaming machine 20. In one embodiment, as illustrated in FIG. 2A, the camera 50 is mounted so that its lens or other information gathering element is directed towards the inner surface of the reel strip 26.

In one embodiment, the reel support 30 has or is formed with an opening at a location other than adjacent the window 28. In the embodiment illustrated, the reel support 30 has an opening 56 a top thereof. The inside surface of the reel strip 26 is visible through this opening 56. The camera 50 is oriented so that the lens faces upwardly towards the opening 56 for obtaining the reel strip 26 information.

In this embodiment, the outcome of the game is determined indirectly. In particular, the image data which is obtained by the camera 50 in this embodiment is not of the actual indicia which are displayed to the player through the window 28 and associated with the payline. Instead, the image information is of the indicia located at an area of the reel strip 26 remote from the portion of the reel strip 26 aligned with the window 28. As the relative positions of the indicia on the reel strip 26 are fixed, however, by knowing the indicia at the location of the opening 56, the indicia located at the window 28 can be readily determined with accuracy.

Figure 2B:
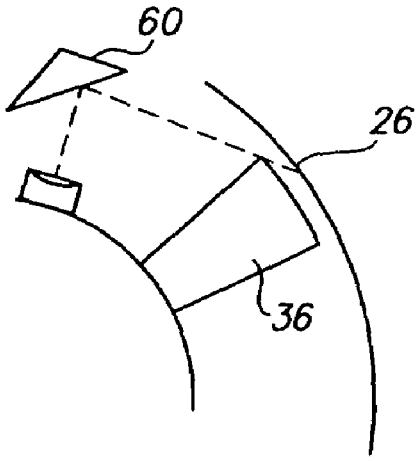
FIG. 2B is a partial side view of a reel of the gaming machine illustrated in FIG. 1 including an image collection device in accordance with another embodiment of the invention.

Another embodiment of an arrangement for the camera 50 is illustrated in FIG. 2B. In this embodiment, means are provided for obtaining image information of the indicia displayed by the reel strip 26 at the location of the window 28.

As described above, in some embodiments, the reel design is such that light shields or shades 36 extend towards the inner surface of the reel strip 26 in the location of the window 28. In this configuration, it may not be possible to locate a camera so that its lens can directly point at the portion of the reel strip 26 aligned with the window 28 because the line of sight of the camera lens is blocked by the shade 36. This arrangement may also be useful when the camera is too large to fit within a space which permits the camera lens to be directed at the reels.

In one embodiment, as illustrated in FIG. 2B, a mirror 60 is provided. The mirror 60 is arranged to collect light from the inner surface of the reel strip 26 at an area aligned with the window 28 and direct it to the lens of the camera 50. The mirror 60 may be of a variety of types and sizes, and is preferably connected to the gaming machine 20, such as to the reel mount 32. Of course, more than one mirror 60 may be utilized, and the exact placement of the mirror(s) and camera 50 may vary.

Of course, in a configuration where the camera may be oriented so that the line of sight from the lens to the inner surface of the reel strip 26 at the location of the window 28 is not blocked, then no mirror may be needed. This may be the case, for example, if there are no shades 36 or the shades are sufficiently set back from the inner surface of the reel strip 26.

In another embodiment, if a direct line of sight is not available, the inside surface of the reel 26 may be printed with matching indicia to the outside surface, but with the indicia offset by a distance to where the camera is located. Game outcome is then determined by known relative positions of the indicia printed on the inside and outside surfaces of the reel strip.

Figure 2C:
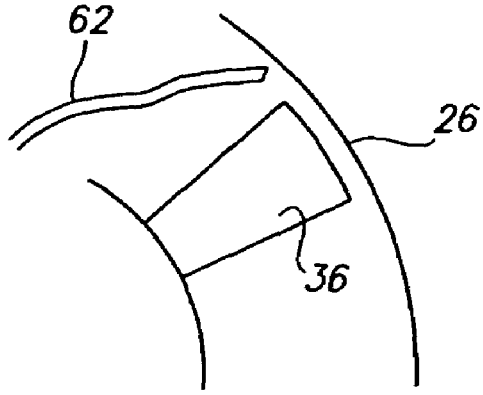
FIG. 2C is a partial side view of a reel of the gaming machine illustrated in FIG. 1 including an image collection device in accordance with yet another embodiment of the invention.

In another embodiment, as illustrated in FIG. 2C, an optic fiber 62 or other light transmitting element, such as one or more lenses, is provided. The optic fiber 62 may have a first end positioned near the reel strip 26 in an area aligned with the window 28, and have its second arranged to provide an output to the camera.

It will be appreciated that in one or more embodiments where there are multiple reels 24, it may be necessary to associate at least one camera 50 with each of the reels 24 in order to capture the desired information. In one embodiment, multiple cameras may be used with each reel 24.

In one or more embodiments, the camera 5 may be moveable, whereby the various areas of image collection may be changed. For example, the camera 50 may be mounted in a manner permitting it to rotate from side to side, pivot up and down, and/or travel laterally or vertically.

As also indicated above, in another embodiment, the camera 50 may be provided with a zoom feature for changing the areas of focus. In one or more embodiments, the zoom may comprise an optical zoom or a digital zoom. These features of the camera 50 may be controlled remotely, such as via a control unit, as described in more detail below. In a preferred embodiment for reducing overhead of control and maintenance of the system, the camera 50 is mounted and then calibrated (such as by a focus mechanism) to its orientation relative to the reel strip 26 it is to obtain image information of.

Software or hardware, such as associated with a camera (video) controller or with a main gaming machine controller or other device, may be used to perform image enhancement. Software may also be provided for detecting motion, whereby image data is only collected when the reel is rotating and for a short time after it stops. This avoids collection of data during periods of time when the gaming machine is not being used.

In accordance with an additional aspect of the invention, other game or session information may be collected. In one embodiment, information or data is collected regarding a player's inputs, as well as internally generated information. Preferably, this information pertains to events other than those which are or may be captured by the cameras 50. For example, these inputs and other information may comprise information regarding player inputs such as depression of a hold, discard, bet credits/bet max, spin or cash out button, and other information such as coins in, lines played, random number(s) generated, and other internally generated information such as electronic game outcome data.

Various means may be used to collect the session information and, in one embodiment, generate one or more session files and associate the collected information with the session file or files. In one embodiment, the means may comprise a main gaming machine controller (described in one embodiment below).

In one embodiment, one or more session files may be generated and used to collect and store this information. The session file may include particular fields with which particular information is associated. For example a "coins in" field may be filled with "3" once a player has bet or inserted three or coins.

As with the image information collected with the cameras 50, the session information may be stored locally, overwritten, and/or transmitted to a remote location. The session information may be stored with the image information, such as at a common memory, or at a separate location or device.

The session information may also be used to effect a "replay" of a game at a display at the gaming machine or a remote location.

In one embodiment, the session data or information may be stored with the image information. The collected session information or data may be synchronized with the image information. In one embodiment, the collected session information is time stamped, as is the image information, so that both sets of information and the events they represent may be synchronized. For example, a player's depression of a "spin" button may be confirmed to occur before the spinning of the reels and the stoppage of the reels at the location verified by the image information. In this embodiment, when the image information is replayed, the session data may be simultaneously presented. For example, at the particular points in time when a particular player input occurred, this input, as documented by the session file, may be indicated on the presented image information.

Additional information regarding how this type of session information may be collected, stored and used is provided in co-pending U.S. application Ser. No. 10/243,353 filed Sep. 13, 2002, which is incorporated by reference in its entirety.

Various aspects of the methods of use of the camera(s) 50 and the session information, as well as the advantages thereof, are described in detail below.

In one embodiment, one or more lights may be provided for illuminating areas of the reel strip 26 where image information is to be gathered. For example, a light may be connected to the reel mount 32 and project light towards the reel strip 26 through the opening 56. Alternatively, the light may be directed towards the outside of the reel strip 26 at the location of the opening 56 in the reel support 30 for back-lighting the reel strip 26. In one embodiment, the light(s) need not operate at all times, but may be operated in flash fashion to illuminate the reel strip 26 only at particular times, such as when image information is being collected by the camera 50.

In one embodiment, each camera 50 is arranged to obtain still image information or data. In one embodiment, each camera 50 may be arranged to provide moving image information or data.

Means are preferably provided for storing the collected image information. In one embodiment, each camera 50 includes or is connected to a memory device, such as a semiconductor type memory device (e.g. RAM, EEPROM or other flash memory), magnetic type memory device (e.g. hard drives), or optical type memory device (e.g. CD/DVD), or other data storage devices now known or later developed. Preferably, the memory is rewriteable. In this embodiment, the output of the camera 50 is a digital signal representative of the image(s) and that data is stored at the memory device. In one embodiment, the image information is overwritten once the memory is full, oldest information first, as new image information is obtained. In other embodiments, a variety of differing information storage devices may be used. For example, if the output of the camera 50 is an analog output, then the information may be output to a video tape or similar element. Further, a central information storage system may be utilized by all of the cameras 50 associated with the gaming machine 20.

In one embodiment, the collected information is stored at a memory device associated with the camera 50 and is continuously written/re-written. The information is not transmitted from the camera 50 unless the camera is polled, such as from a remote service. In other embodiments, as described, the collected information may be transmitted from the camera 50 to a remote location on a continuous basis or at predetermined intervals.

In the arrangement described, collected image information may be obtained from the memory device(s) in variety of manners. For example, if the image information needs to be obtained for review, the video tape(s) may be obtained or the information downloaded through an appropriate interface from the RAM or other memory.

Figure 3:
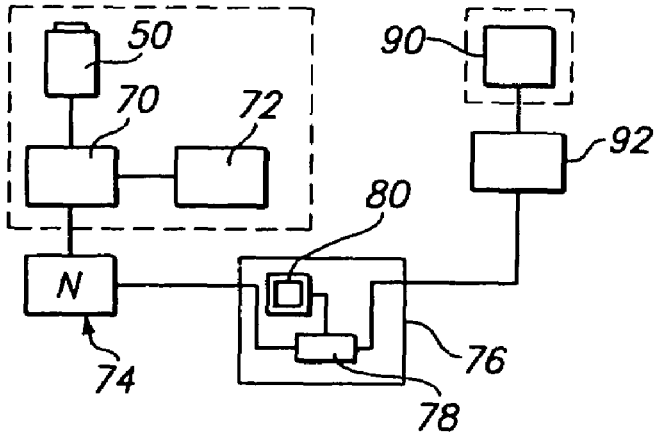
FIG. 3 is a schematic illustrating a control and monitoring system for a gaming machine including an image collection device in accordance with the invention.

In a preferred embodiment, means are provided for controlling the cameras 50 and utilizing the data collected or obtained thereby from a remote location. FIG. 3 illustrates one configuration of a control system for the one or more cameras 50 of the gaming machine 20. In one embodiment, the control system includes a controller 70. The controller 70 may have a variety of forms. In one embodiment, the controller 70 includes a data processing device or "processor." The processor may be of a variety of types, including one or the many readily commercially available such as those manufactured by AMD, Sun Microsystems and Intel.

In one embodiment, a memory 72 or other information storage device for storing data is associated with the controller 70. The memory 72 may be of a variety of types, such as RAM, SDRAM, DRAM, EEPROM and Flash RAM. In one or more embodiments, the memory 72 may include a mass storage device such as a hard drive, CD-RW, DVD-RAM, DVD R/W, compact flash RAM or the like for storing larger quantities of data.

In one embodiment, the controller 70 includes a bus (not shown). The processor of the controller 70 may be connected to the bus. Further, the memory 72 or other peripheral devices to the controller 70 are associated with a bus (not shown).

The bus may be of a variety of types. In one embodiment, the bus is a bi-directional system bus which may contain, for example, thirty-two address lines for addressing a video memory or main memory. The bus may preferably also include a thirty-two or sixty-four bit data bus for transferring data between the components associated with the bus. Alternatively, multiplex data/address lines may be used instead of separate data and address lines.

Preferably, the cameras 50 are associated with the controller 70 via the bus. This association permits the cameras 50 to transmit image data to the controller 70, and allows the processor to send data, such as camera control instructions (such as tilt, pan, zoom, turn on, turn off) to each camera 50.

The cameras 50 may be connected to the bus in a variety of manners, such as via a wired RS-232 connection, a USB connection, an IEEE-1394 (Firewire®) connection, or even a wireless communication link. It will be appreciated that in those cases, appropriate communication devices/interfaces may be provided.

In the one embodiment, data in digital form may be transmitted to and from each camera 50. If the cameras 50 are adapted to provide an analog output, this output may be converted to digital format using an A/D converter, and then be transmitted. As will be appreciated, such data may be directly stored in the memory 72. Alternatively, the analog output may be transmitted and the information in analog form stored by a different storage device. For example, the information storage device may comprise a video tape.

In one embodiment, the collected image and session information may be utilized at the gaming machine 20. For example, the collected image and session information may, as described in more detail below, be replayed to verify the outcome of a game. In one embodiment, the controller 70 may send collected information to a video display associated with the gaming machine, where a replay of the game is effected. The video display may comprise, for example, an LCD or other display. As described in more detail below, the video display by be associated with a player tracking device. The video display may be associated with other systems or devices at the gaming machine, such as a messaging system.

In one embodiment, the image information may be "replayed" in various modes. For example, the image information may be replayed at real speed, at slow speed, or frame by frame. Other replay options may be provided, such as fast forward, reverse, and stop frame or pause. As indicated, in one embodiment, collected session data may be simultaneously presented, including as superimposed with the image information.

In one or more embodiments of the invention, the controller 70 is in communication at one or more times with one or more outside devices via a network or other communication path, such as a security/monitoring network 74. In a preferred embodiment, the security network 74 includes at least one remotely located control station 76. This station may be located in a secure area of a casino. As illustrated, the control station 76 includes a main controller/processor 78.

In one or more embodiments, the security/monitoring network 74 may be a part of another network or comprise any network. For example, the gaming machine 20 may be associated with a player tracking or reward system network for monitoring play data from a remote location. The security/monitoring network 74 may be associated with or comprise one or more portions of such a network. The security/monitoring network 74 may be associated with other devices/networks as well. For example, a portion of the security/monitoring network 74 may include an existing wide area progressive or casino accounting system/network. In this manner, additional wiring or network devices are reduced or eliminated.

In one embodiment, the control station 76 includes a video controller for providing a video output to at least one video monitor/display 80. The monitor 80 may comprise an LCD, CRT or other type of display. More than one display 80 may be associated with the control station 76.

The network 74 includes a communications link provided between the controller 70 and the control station 76. This link may be a wired or wireless communication link. The protocol/architecture of the communications link, including interfaces associated with the camera controller 70 and control station 76, may be of a variety of types. For example, if the link is a wireless link, the protocol/architecture may be Bluetooth, infrared or IEEE 802.11x. For wired links, the protocol/architecture maybe USB, RS-485, IEEE-1394 (Firewire®), Ethernet, or TCP/IP. As noted above, the link may be associated with or provided through another network, such as a player tracking network.

In accordance with this system, collected image and session information may be transmitted to the remote station 76 for viewing and/or storage. The details of the use of the cameras 50 and the remote station 76 are described in greater detail below.

Of course, the system for controlling the cameras 50 and/or obtaining their output may have a variety of other configurations. For example, in one embodiment, the camera 50 may be associated with a peripheral device of the gaming machine 20. The association of the camera 50 with the peripheral device may comprise a physical association or connection, and/or simply a control or communication association.

As in one example described above, the gaming machine 20 may include a player tracking device. The player tracking device may be a "stand-alone" or "add-on" type device which may be used with a variety of gaming machines. In one embodiment, the player tracking device may include a housing for supporting one or more elements.

The player tracking device may include a card reader controlled by a controller. In one embodiment, the cameras 50 are controlled by the controller of the player tracking device. Control may be performed remotely by transmitting instructions from a remote station via the player tracking, system communications network. In addition, as illustrated in FIG. 1, the player tracking device may include a video display, such an LCD display 47. As described above, this display 47 may be used to replay the game using the collected session and/or image information.

The cameras 50 may be associated with additional or other peripheral devices of the gaming machine. For example, one or more security data collection devices may be associated with a credit card reader, bill validator, cash box or the like. It will be appreciated that one or more of these peripherals may be located inside or outside of the gaming machine, and thus the information which is collected may be associated with activities occurring inside and/or outside of the gaming machine.

In a preferred embodiment of the invention, the cameras 50 are controlled by a controller independent of a gaming machine controller. As illustrated in FIG. 3, electronically controlled gaming machines 20 generally include a gaming controller 90. This controller 90 performs a variety of functions in executing the operation of the gaming machine 20, and may control a variety of peripheral devices. For example, the controller 90 may be arranged to control the stepper motor 34 of each reel 24. It may be desirable to control the cameras 50 independently of the gaming controller 90 to ensure that in the event of a malfunction of the controller, the cameras 50 are independently operated and obtain accurate game outcome verification information.

In one embodiment of the invention, however, the cameras 50 may be controlled via the gaming controller 90. Commonly, the gaming machine controller 90 is connected to a network 92, allowing the gaming machine controller 90 to transmit information to a remote location and receive information from a remote location. In one embodiment, the remote location may be the security station 76 of the invention. Or course, if no communication link exists with the gaming controller 90, then such a link may be provided.

As indicated, in one embodiment of the invention, the cameras 50 may provide an analog output. As indicated, this output may be converted to a digital signal using an A/D converter. Alternatively, the analog output may be transmitted for storage at an appropriate memory device and/or transmitted over the network In one embodiment, the various analog signals, such as from multiple cameras, may be multiplexed. The combined modulated signal may conform to the NTSC or PAL standard signal forms. The modulated signal may be transmitted to the remote location 76, such as by a coaxial cable comprising the network link. The remote location 76 may include a tuner for selecting individual camera signals from the modulated signal and displaying the images represented by the individual camera signal on a display.

One or more methods of using the cameras 50 or other image collection devices associated with a gaming machine will now be described. In accordance with the method generally, the controller 70 or other control device (such as located at a remote station) is arranged to cause the cameras 50 to collect image information and store some or all of the image information.

In one embodiment, the controller 70 is arranged to cause the cameras 50 to collect image information at one or more times. In one embodiment, the controller 70 may cause the cameras 50 to collect image information in response to the pull of the "spin" handle or depression of the "spin" button by the player which effects a spin of the reels and the start of the game. The image information is stored in memory 72. As described, the information may be overwritten in loop fashion with new information, whether or not the information is stored locally at the gaming machine or is transmitted for remote storage/use.

In one embodiment, the operation of the camera 50 may be controlled from the remote station 76. For example, security personnel may send commands from the remote station 76 via the network 74 to the controller 70. The controller 70 may then execute these commands. The commands may cause, for example, the cameras to move (such as via a motor control, not shown), zoom or the like. In addition, the command may cause the controller 70 to forward to the remote station 76 collected image information. The forwarded information may comprise image information stored at the memory 72, session data or information, and/or information which is presently being collected and transmitted from the camera 50 in real time. In another embodiment, the information which is forwarded may be forwarded upon instruction on an as-needed basis. Some examples of such instances are described in more detail below.

As will be appreciated, over time, the amount of stored information would become excessively large, resulting in the need for a very large memory or other information storage device associated with the gaming machine. Thus, in one embodiment of the invention, image information is overwritten after a predetermined period of time or after a predetermined amount of information is stored, unless a predetermined event occurs. For example, the memory 72 may be arranged to store up to 30 minutes of image information from each camera or audio data from each microphone. At the beginning of the next 30 minute period, the oldest data from the previous 30 minute period is over-written. Similarly, if the information is stored to a tape, the tape may run in continuous fashion and over-write the older image information. Alternatively, the information may be overwritten after a predetermined amount of information is stored, such as 100 MB in a data storage device.

In one or more embodiments, a variety of data manipulation techniques may be employed to reduce the amount of image data which is transmitted. For example, the collected image data may be compressed, the resolution reduced or the data converted to grey scale. The number of colors for color resolution may be reduced, such as from 16 bit (65,536 colors) to 8 bit (256 colors). The reduced quantity of the image data may then be transmitted, such as over a communication link, or stored. The data may also be encrypted for secure transmission to a remote location.

As indicated, the cameras 50 may be arranged to collect and store image information at certain times. For example, if the cameras 50 are controlled by the gaming machine controller 90, then the cameras 50 may arranged to collect and store image information upon a signal from the controller 90 at game outcome. For example, a game outcome event such as the generation of a payout code for a winning event, may also result in the generation of a signal to the cameras 50. Such events and their occurrence in gaming machines is well known.

As will be appreciated, depending upon the configuration or nature of the data or communication links provided, the bandwidth or total volume of information which may be transmitted over the link may be limited. In that event, it may be desirable to not have the collected security data or information continuously transmitted to the remote station. In one embodiment, the data or information may be transmitted upon request, such as described above upon a signal from the control station 76.

In another embodiment, if a "trigger" event occurs, then collected image and/or session data is automatically transmitted to the control station 76. For example, in one embodiment, such a trigger event may comprise a signal from a gaming machine controller 90 to the remote station 76 of the a particular winning outcome, such as a winning outcome associated with the award of a very large jackpot, or other events, such as a game machine malfunction. In one embodiment, each gaming machine controller 90 is arranged to send a signal representative of certain events, along with gaming machine identification information. In one embodiment, the remote station 76 is arranged to receive signals from the gaming machine controller 90, such as through a communication interface with the game machine network 92. Further, the controller 78 is arranged to process such signals, and in response to a signal from a particular gaming machine controller 90, send a signal to the camera controller 70 for that gaming machine 20.

In one embodiment, the cameras 50 may be activated only when gaming activity is occurring. For example, the cameras 50 may be activated when a player places a wager (such as by detection of an input coin or currency) or by insertion of a player tracking card or input to one of the buttons of the gaming machine. When game play stops, the security collection devices may be deactivated. In one embodiment, if no gaming activity is detected for more than 5 minutes, the cameras 50 may be deactivated. The security data collection devices may then remain deactivated until game play resumes. In this arrangement, the camera controller 70 may be interfaced with another portion of the gaming machine 20, such as the gaming machine controller 90, in order to receive information regarding gaming machine activity. Alternatively, as indicated above, motion detection may be used to detect game play.

It will be appreciated that a wide variety of systems and devices may be utilized to accomplish the method(s). For example, control instructions may be programmed directly into a controller of each camera. Alternatively, an entirely separate camera control and information storage system may be provided. This system may be associated with the gaming controller or be separate. In one embodiment, the gaming controller 90 could be a remote game server which provides both game control data to the gaming machine and camera control and other instructions and data, such as via a network link.

Figure 4:
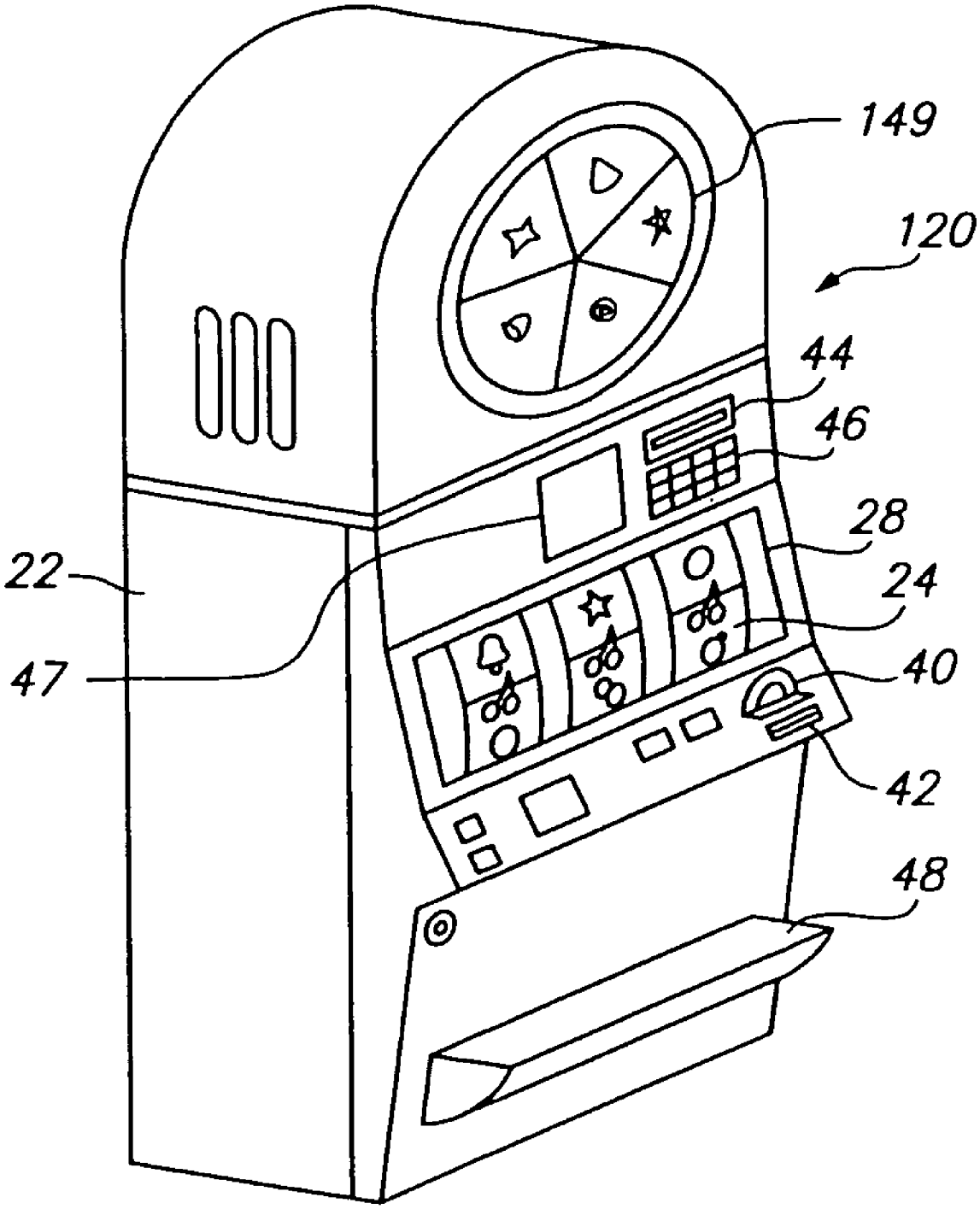
FIG. 4 is a perspective view of a gaming machine comprising another environment for an apparatus and method of the invention, the gaming machine including a bonus game.

The various aspects of the invention may also be applied to gaming machines having other configurations. For example, the principles of the invention may be applied to a gaming machine 120 such as that illustrated in FIG. 4 which includes a secondary or bonus game or event. Such gaming machines 120 are well known.

In the embodiment illustrated, the gaming machine 120 includes a main game. The main game may be of a variety of types, such as a slot game as described above with respect to the gaming machine 20 illustrated in FIG. 1, or a video type game.

The gaming machine 120 also includes a bonus feature. As illustrated, the bonus feature comprises a rotatable wheel 149. In one embodiment, upon a player receiving a particular outcome while playing the main game, the bonus feature is triggered. As illustrated, the wheel 149 is rotated, with the stopping position corresponding to a bonus outcome in the form of additional winnings.

A wide variety of other bonus or secondary games or events are known. For example, referring to FIG. 1, a bonus event or game may be displayed using a secondary video display 49.

In one embodiment of the invention, an image collection device may be utilized to collect data regarding the secondary or bonus game or event. For example, referring to FIG. 4, one or more cameras may be used to collect image information regarding the movement of the bonus wheel 149, including the stopping position of the wheel 149, in similar fashion to the reels of the gaming machine 20 illustrated in FIG. 1. This collected information may be utilized to confirm the outcome of the secondary or bonus game or event.

In one embodiment of the invention, regardless of the type of secondary or bonus game or event, the collected session data or information may comprise or include the secondary or bonus game or event information. For example, the collected session data may include electronically generated bonus event outcome information. The collected session data may include player input where such is permitted, such as when a player's input effects the bonus game when a bonus game is permitted.

In the case of a secondary or bonus game or event presented by a video display, such as illustrated in FIG. 1, the session data or information may comprise or include various information regarding the bonus event such as a player input to initiate the bonus event, a generated random number used to define the outcome of the event, or other outcome information.

It will also be appreciated that various of the features described with respect to the collection, transmission and use of image data also apply to the use and collection of the session information. For example, various means may be provided for collecting, storing and transmitting/using the session information. The session information may be compressed, encrypted or otherwise manipulated.

It will be understood that the above described arrangements of apparatus and the method therefrom are merely illustrative of applications of the principles of this invention and many other embodiments and modifications may be made without departing from the spirit and scope of the invention as defined in the claims. Features of the invention described herein may be provided alone or in any combination.

We claim:

1. A method of verifying the outcome of a game played on a gaming machine, said gaming machine including a housing, comprising:

spinning at least one reel, wherein the reel displays an indicia; and collecting image information regarding a position of the reel with at least one image collection device, wherein the gaming machine includes a window through which a portion of the reel is visible, wherein the at least one image collection device is located within the housing of the gaming machine and positioned to collect image information regarding a position of the at least one reel from a portion of the reel not visible through the window at a time when the image information is collected, wherein said image collection device comprises a camera having a lens, and wherein said lens of said camera is directed at said reel.

2. The method in accordance with claim 1 including the step of collecting image information regarding execution of a secondary event at said gaming machine.

3. The method in accordance with claim 2 including the step of providing at least one second image collection device in a position to collect information regarding execution of said secondary event.

4. The method in accordance with claim 1 including the step of storing said collected information in a circular buffer.

5. The method in accordance with claim 1 including the step of generating a session file, collecting data pertaining to events occurring at said gaming machine associated with the presentation and play of a game at said gaming machine, said data including one or more inputs by a player of said gaming machine.

6. The method in accordance with claim 5 wherein said data comprises information regarding one or more events from the group consisting of hold, discard, coins in, credits bet, spin, deal, cash out, lines played, and game outcome.

7. The method in accordance with claim 5 including the step of collectively storing said data and said collected image information.

8. The method in accordance with claim 5 including the step of synchronizing said data and said collected image information.

9. The method in accordance with claim 8 wherein said step of synchronizing comprises the step of associating time of event information with said data and said collected image information.

10. The method in accordance with claim 1 wherein said collecting step occurs when said at least one reel is in a stopped position associated with the outcome of a game presented at said gaming machine.

11. The method in accordance with claim 1 including the step of transmitting said collected information to a remote location.

12. The method in accordance with claim 11 including the step of compressing said collected image information before said transmitting step.

13. The method in accordance with claim 11 including the step of encrypting said collected image information before said transmitting step.

14. The method in accordance with claim 11 wherein said collected information is transmitted in real time.

15. The method in accordance with claim 11 wherein said collected information is transmitted in response to the occurrence of at least one particular event.

16. The method in accordance with claim 15 wherein said at least one particular event comprises a predetermined winning outcome.

17. The method in accordance with claim 16 wherein said predetermined winning outcome is associated with the award of a jackpot.

18. The method in accordance with claim 15 wherein said at least one particular event comprises a malfunction.

19. The method in accordance with claim 1 wherein said reel comprises a reel strip having an outer surface for viewing by a player of said gaming machine and an inner surface, and said image collection device is directed at said inner surface of said reel strip.

20. The method in accordance with claim 1 including the step of utilizing said collected image information to recreate said game.

21. The method in accordance with claim 20 wherein said collected image information is presented on a display associated with said gaming machine.

22. The method in accordance with claim 21 wherein said associated display is a player tracking device display.

23. The method in accordance with claim 21 wherein said associated display is a gaming machine secondary display.

24. The method in accordance with claim 20 including the step of transmitting said collected image information and displaying said information at a remote location.

25. The method in accordance with claim 1 including the steps of generating a session file, collecting data pertaining to events occurring at said gaming machine associated with the presentation and play of a game at said gaming machine, said data including one or more inputs by a player of said gaming machine, and replaying said game by presenting said image information and superimposing said collected data thereon.

26. An apparatus for verifying the outcome of a game played on a gaming machine including at least one reel arranged to present one or more indicia for viewing to a player, the position of said at least one reel associated with the outcome of said game, comprising:

at least one image collection device located in said gaming machine and arranged to collect image information regarding said reel, wherein said gaming machine includes a window through which a portion of said reel is visible, wherein said image collection device is arranged to collect image information from a portion of said reel not visible through said window at a time when said image information is collected, and wherein said at least one image collection device comprises a camera having a lens, said lens directed at said reel at one or more times; and a memory adapted to store collected image information.

27. The apparatus in accordance with claim 26 wherein said at least one image collection device is also arranged to collect image information regarding a secondary game executed at said gaming machine.

28. The apparatus in accordance with claim 26 including at least one secondary image collection device arranged to collect image information regarding a secondary game executed at said gaming machine.

29. The apparatus in accordance with claim 26 including a controller adapted to control the operation of said image collection device and associate collected information with said memory.

30. The apparatus in accordance with claim 29 wherein said controller is adapted to cause said at least one image collection device to collect image information when said at least one reel is in a stopped position at the conclusion of a game presented at said gaming machine.

31. The apparatus in accordance with claim 29 including a communication interface associated with said at least one image collection device permitting collected image information to be transmitted to a remote location.

32. The apparatus in accordance with claim 26 wherein said camera is a digital camera.

33. The apparatus in accordance with claim 26 wherein said reel comprises a reel strip mounted upon a reel support defining a generally circular pathway of said reel strip and wherein said at least one image collection device is located within said circular pathway of said reel strip.

34. The apparatus in accordance with claim 26 wherein said memory is selected from the group consisting of magnetic, optical and semiconductor type devices.

35. The apparatus in accordance with claim 26 wherein said gaming machine includes at least three reels and at least one image collection device for each reel.

36. A gaming machine comprising:

at least one rotating reel strip adapted to display one or more indicia;

a stopping position of said reel strip associated with an outcome of a game played on said machine, said reel strip having an inner surface and an outer surface; and at least one image collection device, said image collection device located within said gaming machine, said image collection device configured to collect image information regarding a position of said reel strip, wherein said gaming machine includes a window through which a portion of said reel strip is visible, wherein said image collection device is arranged to collect image information from a portion of said reel strip not visible through said window at a time when said image information is collected, and wherein said at least one image collection device comprises a camera having a lens directed at said inner surface of said reel strip.

37. The gaming machine in accordance with claim 36 including means for generating a session file and collecting game play information and associating it with said session file.

38. The gaming machine in accordance with claim 36 wherein said reel strip is mounted for rotation about a reel support, said reel support including a mount, said at least one image collection device connected to said mount.

39. The gaming machine in accordance with claim 36 wherein said image collection device is arranged to collect image information regarding a position of said reel strip at a location other than that corresponding to said window.

40. The gaming machine in accordance with claim 36 wherein said image collection device is further arranged to collect image information of the one or more indicia visible to said player through said window.

* * * * *